US010821630B2

(12) United States Patent
Kaneider et al.

(10) Patent No.: US 10,821,630 B2
(45) Date of Patent: Nov. 3, 2020

(54) METHOD FOR CONTROLLING A WALL SAW SYSTEM DURING THE CREATION OF A SEPARATION CUT

(71) Applicant: Hilti Aktiengesellschaft, Schaan (LI)

(72) Inventors: Wilfried Kaneider, Rankweil (AT); Dragan Stevic, Feldkirch-Tosters (AT); Christian Bereuter, Lingenau (AT); Peter Hricko, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 340 days.

(21) Appl. No.: 15/509,425

(22) PCT Filed: Sep. 2, 2015

(86) PCT No.: PCT/EP2015/070008
§ 371 (c)(1),
(2) Date: Aug. 21, 2017

(87) PCT Pub. No.: WO2016/037911
PCT Pub. Date: Mar. 17, 2016

(65) Prior Publication Data

US 2018/0169898 A1 Jun. 21, 2018

(30) Foreign Application Priority Data

Sep. 8, 2014 (EP) ..... 14003099

(51) Int. Cl.
*B28D 1/04* (2006.01)
*B28D 7/00* (2006.01)

(52) U.S. Cl.
CPC ..... *B28D 1/042* (2013.01); *B28D 1/044* (2013.01); *B28D 1/045* (2013.01); *B28D 7/005* (2013.01)

(58) Field of Classification Search
CPC ..... B28D 7/005; B28D 1/04; B28D 1/042; B28D 1/044; B28D 1/045; B28D 1/048;
(Continued)

(56) References Cited

U.S. PATENT DOCUMENTS 5,887,579 A * 3/1999 Eriksson ..... B27B 5/08 125/13.01
7,337,037 B2 * 2/2008 Schaer ..... B23D 59/002 125/13.01
(Continued)

FOREIGN PATENT DOCUMENTS

EP 1 693 173 B1 8/2006
WO WO 2014/124912 A1 8/2014
(Continued)

OTHER PUBLICATIONS

PCT/EP2015/070008, International Search Report dated Nov. 10, 2015, with partial English translation (Seven (7) pages).
(Continued)

*Primary Examiner* — Evan H MacFarlane
(74) *Attorney, Agent, or Firm* — Crowell & Moring, LLP

(57) ABSTRACT

A method for controlling a wall saw system during creation of a separating cut in a workpiece. The wall saw system includes a saw head, a pivotable saw arm, a first saw blade, and a larger second saw blade. The separating cut is performed in a plurality of main cuts, where the parameters of the main cuts (saw blade diameter of the saw blade used, main-cut angle) are defined before the start in a main-cut sequence. After the processing of the separating cut by the first saw blade is concluded, the controlled processing of the separating cut is interrupted by a control unit and the wall saw is moved into a parking position such that all actions of the saw-blade change (swinging out the saw arm, removing
(Continued)

the first saw blade, installing the second saw blade, and swinging in the saw arm) can be performed.

1 Claim, 7 Drawing Sheets

(58) Field of Classification Search
CPC ..... B28D 1/10; B23D 59/001; B23D 59/002; B23D 59/005; B23D 59/008; B26D 1/14; B26D 1/157; B26D 1/16; B26D 1/18; E21C 25/00; E21C 25/16; E21C 25/18
See application file for complete search history.

(56) References Cited

U.S. PATENT DOCUMENTS

| | | | | |
|---|---|---|---|---|
| 2002/0117160 | A1* | 8/2002 | Acker | B27B 9/02 125/13.01 |
| 2007/0163412 | A1* | 7/2007 | Baratta | B23D 47/02 83/651 |
| 2007/0209651 | A1* | 9/2007 | Ketterhagen | B28D 1/045 125/13.01 |
| 2013/0174707 | A1* | 7/2013 | Jonsson | B27G 19/02 83/478 |
| 2015/0059186 | A1* | 3/2015 | Bermes | B23D 59/001 30/123 |

FOREIGN PATENT DOCUMENTS

| | | | |
|---|---|---|---|
| WO | WO 2014/124931 | A1 | 8/2014 |
| WO | WO 2014/128095 | A1 | 8/2014 |

OTHER PUBLICATIONS

European Search Report issued in European counterpart application No. 14003099.0-1709 dated Apr. 13, 2015, with Statement of Relevancy (Seven (7) pages).
U.S. Patent Application, "Method for Controlling a Wall Saw System When Making a Separating Cut", filed Mar. 7, 2017, Inventor Wilfried Kaneider et al.
U.S. Patent Application, "Method for Controlling a Wall Saw System During the Creation of a Separation Cut", filed Mar. 7, 2017, Inventor Wilfried Kaneider et al.
U.S. Patent Application, "Method for Controlling a Wall Saw System During the Creation of a Separating Cut", filed Mar. 7, 2017, Inventor Wilfried Kaneider et al.
Japanese Notice of Reasons for Refusal issued in Japanese application No. 2017-513095 dated Apr. 4, 2018, with partial English translation (Eight (8) pages).
A Guide for a Scheme of Execution "A Wall Sawing Method", Japan, General Corporate Judicial Person Japan Concrete Sawing & Drilling Association, Jul. 1, 2011, 12$^{th}$ Edition (28 total pages).
English machine translation of JP 49-106678 A, previously cited as B2 on Mar. 7, 2017 (Seven (7) pages).

* cited by examiner

METHOD FOR CONTROLLING A WALL SAW SYSTEM DURING THE CREATION OF A SEPARATION CUT

This application claims the priority of International Application No. PCT/EP2015/070008, filed Sep. 2, 2015, and European Patent Document No. 14003099.0, filed Sep. 8. 2014, the disclosures of which are expressly incorporated by reference herein.

BACKGROUND AND SUMMARY OF THE INVENTION

The present invention relates to a method for controlling a wall saw system during the creation of a separation cut.

A method is known from EP 1 693 173 B1 for controlling a wall saw system during the creation of a separation cut in a workpiece between a first end point and a second end point. The wall saw system, comprises a guide rail and a wall saw with a saw head, a motor-driven feed unit that moves the saw head parallel to a feed direction along the guide rail, and at least one saw blade attached to a saw arm of the saw head and driven by a drive motor about an axis of rotation. The saw arm is pivotable by means of a pivoting motor about a pivot axis. By a pivoting movement of the saw arm about the pivot axis, the penetration depth is changed in the workpiece. The motor-driven feed unit comprises a guide carriage and a feed motor, wherein the saw head is mounted on the guide carriage and moved via the feeding motor along the guide rail. To monitor the wall saw system a sensor device is provided with a pivot angle sensor and a displacement sensor. The pivot angle sensor measures the present pivot angle of the saw arm and the displacement sensor measures the actual position of the saw head on the guide rail. The measured values for the current pivot angle of the saw arm and the actual position of the saw head are regularly sent to a control unit of the wall saw.

The known method for controlling a wall saw system is divided into a preparation part and processing of the separation cut. In the preparation part the operator sets at least the saw blade diameter of the saw blade, the positions of the first and second end point in the feed direction and the final depth of the separation cut; other parameters can be the material of the workpiece to be machined and the dimensions of embedded rebar. From the parameters entered, the control unit determines an appropriate main cutting sequence of main cuts for the separation cut, wherein the main cutting sequence comprises at least a first main cut having a first main cutting angle of the saw arm and a first diameter of the saw blade used, and a following second main cut with a second main cutting angle of the saw arm and a first diameter of the saw blade used.

The known method for controlling a wall saw system discloses no details on how the exchange of the saw blade and blade guard is done during the controlled processing of the separation cut.

The object of the present invention is to develop a method for controlling a wall saw system with high processing quality, in which the exchange of a saw blade and a blade guard is integrated into the controlled processing of a separation cut.

This object is achieved according to the invention in the method for controlling a wall saw system mentioned by the features of the independent claim. Advantageous developments are specified in the dependent claims.

The invention is characterized in that after processing of the separation cut with the first blade, the controlled processing of the separation cut is interrupted by the control unit and the wall saw is moved by the control unit into a park position.

By integrating a saw blade change and blade guard change in the controlled processing with the control unit, all boundary conditions can be taken into account by the control unit and the wall saw can be positioned in a park position in which all actions can be performed by the saw blade and blade guard exchange. When changing the saw blade from a first blade to a second blade and the blade guard from a first blade guard to a second blade guard the following are to be considered as boundary conditions:

- dismounting of the first blade and first blade guard,
- mounting of the second saw blade and second blade guard,
- pivoting of the saw arm with the first saw blade from the first main cutting angle into the basic position, and
- pivoting the saw arm with the second saw blade from the basic position into the second main cutting angle.

Preferably the wall saw after the exchange of the saw blade from the first to the second saw blade and the resumption of the controlled processing by the control unit is positioned in a resumption position. If the control unit in addition to the park position determines a resumption position, after the interruption the wall saw can be moved by the operator from the park position by means of the motor-driven feed unit along the guide rail. The possibility of being able to move the wall saw from the park position is advantageous for vertical or diagonal separation cuts in a wall in which the park position is arranged above a manageable mounting position. For dismounting the first equipment (first saw blade and first blade guard) and mounting the second equipment (second saw blade and second blade guard), the operator moves the saw head into a mounting position suitable for him/her. After the resumption, the control unit with the aid of the displacement sensor checks the current position of the wall saw. If the current position deviates from the resumption position, the wall saw is positioned in the resumption position.

In a preferred embodiment, before the start of the processing controlled by the control unit additionally a length of the saw arm is determined, defined as the distance between the pivot axis of the saw arm and the axis of rotation of the saw blade, and the distance between the pivot axis of the saw arm and an upper side of the workpiece. For a controlled processing of the separation cut, the control unit must know various parameters. These include the saw arm length, which represents a fixed device-specific size of the wall saw, and the vertical distance between the pivot axis and the surface of the workpiece, which besides the geometry of the wall saw also depends on the geometry of the guide rail used.

In the calculation of the park position for an exchange of the saw blade and/or blade guard, a distinction must be made: the exchange takes place at a free end point without barrier (first embodiment), the saw blade is exchanged at a barrier without blade guard (second embodiment), the saw blade and blade guard are exchanged at a barrier for the second saw blade without blade protection (third embodiment), and the saw blade and blade guard are exchanged at a barrier for a second saw blade and second blade guard (fourth embodiment).

In the first embodiment, the second end point is a free end point without barrier and the second diameter of the second saw blade set before the start is used for calculation of the first park position and the resumption position corresponding to the first park position. The pivot axis in the first park position has a distance to the second end point of $\sqrt{[h_2(D.2-h_2)]}+\delta\cdot\sin(\pm\alpha_2)$, where $h_2=h(\pm\alpha_2, D.2)=D.2/2-\Delta-\delta\cdot\cos(\pm\alpha_2)$ designates the penetration depth of the second saw blade into the workpiece at the second main cutting angle with the preset second saw blade diameter.

As an alternative to the preset second saw blade diameter, the second saw blade diameter of the second saw blade is adjustable between a maximum second saw blade diameter and a minimum second saw blade diameter, wherein the maximum second saw blade diameter is used for calculating a second park position. With a saw blade, its diameter changes because of wear in the processing and declines over time, where the difference between the maximum and minimum second saw blade diameters corresponds to the height of the cutting segments.

The pivot axis in the second park position has a distance to the second end point of $\sqrt{[h_{2.max}(D_{max}.2-h_{2.max})]}+\delta\cdot\sin(\pm\alpha_2)$, where $h_{2.max}=h_{max}(\pm\alpha_2, D_{max}.2)=D_{max}.2/2-\Delta-\delta\cdot\cos(\pm\alpha_2)$ designates the maximum penetration depth of the second saw blade into the workpiece at the second main cutting angle with the maximum second saw blade diameter. Calculating the second park position with the maximum second saw blade diameter assures that the second park position is suitable for all actual saw blade diameters of the second saw blade.

After the resumption of the controlled processing the wall saw is positioned in a resumption position corresponding to the second park position. The resumption of the controlled processing in the second park position is possible for all actual saw blade diameters of the second saw blade; however, it has an inaccuracy in the positioning.

Preferably, before the resumption of the controlled processing the actual second saw blade diameter of the second saw blade is entered and used for calculating a resumption position. In the recalculated resumption position the pivot axis has a distance to the second end point of $\sqrt{[h_2(D_{real}.2-h_2)]}+\delta\cdot\sin(\pm\alpha_2)$, where $h_2=h(\pm\alpha_2, D_{real}.2)=D_{real}.2/2-\Delta-\delta\cdot\cos(\pm\alpha_2)$ designates the penetration, depth of the second saw blade into the workpiece at the second main cutting angle with the actual second saw blade diameter. The entry of the actual second saw blade diameter enables an exact control of the wall saw. The park position is calculated such that any permissible saw blade diameter for the second saw blade can be mounted. Through the calculation of the resumption position with the actual second saw blade diameter, the control of the wall saw can be done through the upper exit point of the saw blade.

In the further embodiments, the second end point is defined as a barrier and before the start of the controlled processing a mounting distance is additionally established, wherein the mounting distance is additionally used for calculating a third to fifth park position. The mounting distance assures a sufficient distance for the operator between the barrier and the saw blade and between the barrier and the blade guard to engage the saw blade and blade guard.

The control unit calculates different park positions depending on the boundary conditions of the processing. In the third park position the first and second saw blades are used without blade guards. In the fourth park position, the first saw blade is surrounded by the first blade guard and the processing is done with the second saw blade without blade guard. In the fifth park position, the change occurs from the first saw blade with first blade guard to the second saw blade with second blade guard. The park positions must meet the four boundary conditions (dismounting, mounting, pivoting out and pivoting in) and are dependent on the first main cutting angle of the first main cut and the second main cutting angle of the second main cut.

In the third park position the processing occurs with the first and second saw blades without blade guards. For the main cutting angle, three angle areas of −180° to 0°, 0° to 90° and 90° to 180° must be distinguished, thus yielding a total of nine different distances for the third park position.

In the first angle area, the saw arm before the interruption of the controlled processing is arranged at a negative first main cutting angle between −180° and 0° and the pivot axis in the third park position has a distance to the second end point of maximum value of $[D_1/2+\Delta_{mount}, D_2/2+\Delta_{mount}]$ for $-180°\leq-\alpha_2\leq0°$, maximum value of $[(D_1/2+\Delta_{mount}, D_2/2+\Delta_{mount}, D_2/2+\delta\cdot\sin(\alpha_2)]$ for $0°<\alpha_2\leq90°$ and maximum value of $[D_1/2+\Delta_{mount}, D_2/2+\Delta_{mount}, D_2/2+\delta\cdot\sin(90°)]$ for $90°<\alpha_2\leq180°$. For all negative main cutting angles the displacement $\delta\cdot\sin(-\alpha_1)$ is negative, and therefore in principle applies $D_1/2+\delta\cdot\sin(-\alpha_1)<D_1/2+\Delta_{mount}$. If the second diameter $D_2$ is greater than the first diameter $D_1$, in principle applies $D_1/2+\Delta_{mount}<D_2/2+\Delta_{mount}$.

In the second angle area, the saw arm before the interruption of the controlled processing is arranged at a positive first main cutting angle between −0° and 90° and the pivot axis in the third park position has a distance to the second end point of maximum value of $[D_1/2+\Delta_{mount}, D_2/2+\Delta_{mount}, D_1/2+\delta\cdot\sin(\alpha_1)]$ for $-180°\leq-\alpha_2\leq0°$, maximum value of $D_1/2+\Delta_{mount}, D_2/2+\Delta_{mount}, D_1/2+\delta\cdot\sin(\alpha_1), D_2/2+\delta\cdot\sin(-\alpha_2)]$ for $0°<\alpha_2\leq90°$ and maximum value of $[D_1/2+\Delta_{mount}, D_2/2+\Delta_{mount}, D_2/2+\delta\cdot\sin(90°)]$ for $90°<\alpha_2\leq180°$. For all negative second main cutting angles the displacement $\delta\cdot\sin(-\alpha_2)$ is negative, and therefore in principle applies $D_2/2+\delta\cdot\sin(-\alpha_2)<D_2/2+\Delta_{mount}$.

In the third angle area, the saw arm before the interruption of the controlled processing is arranged at a positive first main cutting angle between 90° and 180° and the pivot axis in the third park position has a distance to the second end point of maximum value of $[D_1/2+\Delta_{mount}, D_2/2+\Delta_{mount}, D_1/2+\delta\cdot\sin(90°)]$ for $-180°\leq-\alpha_2\leq0°$ and maximum value of $[D_1/2+\Delta_{mount}, D_2/2+\Delta_{mount}, D_2/2+\delta\cdot\sin(90°)]$ for $90°<\alpha_2\leq180°$.

In a first preferred embodiment, for calculating the third park position for the first diameter of the first main cut the preset first saw blade diameter of the first saw blade and for the second diameter of the second main cut the preset second saw blade diameter of the second saw blade are used. Preferably the wall saw after the resumption of the controlled processing by the control unit is positioned in a resumption position corresponding to the third park position.

In a second preferred embodiment, the second saw blade diameter between a maximum second saw blade diameter and a minimum second saw blade diameter is adjustable, and for calculating the park position for the second diameter of the second main cut the maximum second saw blade diameter is used. Calculating the park position with the maximum second saw blade diameter assures that the park position is suitable for all actual saw blade diameters of the second saw blade.

The wall saw is either positioned in a resumption position corresponding to the park position or before the resumption of the controlled processing the actual second saw blade diameter of the second saw blade is entered and used for calculating a resumption position. The pivot axis in the resumption position has a distance to the second end point of $D_{real}.2/2$ for $-180°\leq-\alpha_2\leq0°$, $D_{real}2/2+\delta\cdot\sin(\alpha_2)$ for $0°\leq\alpha_2\leq90°$, and $D_{real}2/2+\delta\cdot\sin(90°)$ for $90°\leq\alpha_2\leq180°$.

In the third embodiment, before the start of the controlled processing for the first saw blade a first blade guard with a first blade guard width is determined, wherein the first blade guard width is compiled from a first distance of the axis of rotation to the first blade guard edge and a second distance of the axis of rotation to the second blade guard edge, and the second distance is additionally used for calculating the fourth park position. In processing with the first blade guard, the fourth park position depends on the first and second main cutting angles. For the main cutting angles, three angle areas of −180° to 0°, 0° to 90°, and 90° to 180° are to be distinguished, yielding a total of nine different distances for the fourth park position.

In the first angle area the saw arm before the interruption of the controlled processing is arranged at a negative first main cutting angle between −180° and 0° and in the fourth park position the pivot axis has a distance to the second end point of maximum value $[B_b.1+\Delta_{mount}, D_2/2+\Delta_{mount}]$ for $-180° \leq -\alpha_2 \leq 0°$, maximum value of $(B_b.1+\Delta_{mount}, D_2/2+\Delta_{mount}, D_2/2+\delta\cdot\sin(\alpha_2)]$ for $0° < \alpha_2 \leq 90°$ and maximum value of $[B_b.1+\Delta_{mount}, D_2/2+\Delta_{mount}, D_2/2+\delta\cdot\sin(90°)] < \alpha_2 \leq 180°$.

In the second angle area the saw arm before the interruption of the controlled processing is arranged at a positive first main cutting angle between 0° and 90° and in the fourth park position the pivot axis has a distance to the second end point of maximum value $[B_b.1+\Delta_{mount}, D_2/2+\Delta_{mount}, B_b.1+\delta\cdot\sin(\alpha_1)]$ for $-180° \leq -\alpha_2 \leq 0°$, maximum value of $(B_b.1+\Delta_{mount}, D_2/2+\Delta_{mount}, B_b.1+\delta\cdot\sin(\alpha_1), D_2/2+\delta\cdot\sin(\alpha_2)]$ for $0° < \alpha_2 \leq 90°$ and maximum value of $[B_b.1+\Delta_{mount}, D_2/2+\Delta_{mount}, B_b.1+\delta\cdot\sin(\alpha_1), D_2/2+\delta\cdot\sin(90°)]$ for $90° < \alpha_2 \leq 180°$.

In the third angle area the saw arm before the interruption of the controlled processing is arranged at a positive first main cutting angle between 90° and 180° and in the fourth park position the pivot axis has a distance to the second end point of maximum value $[B_b.1+\Delta_{mount}, D_2/2+\Delta_{mount}, B_b.1+\delta\cdot\sin(90°)]$ for $-180° \leq -\alpha_2 \leq 0°$, maximum value of $(B_b.1+\Delta_{mount}, D_2/2+\Delta_{mount}, B_b.1+\delta\cdot\sin(90°), D_2/2+\delta\cdot\sin(\alpha_2)]$ for $0° < \alpha_2 \leq 90°$ and maximum value of $[B_b.1+\Delta_{mount}, D_2/2+\Delta_{mount}, B_b.1+\delta\cdot\sin(90°)]$ for $90° < \alpha_2 \leq 180°$.

After the resumption of the controlled processing the wall saw is positioned in a resumption position corresponding to the fourth park position. In the resumption position the wall saw is pivoted to the second main cutting angle and the saw head is then moved in a negative feed direction counter to the positive feed direction in the direction of the first end point.

In the fourth embodiment, before the start of the controlled processing for the second saw blade a second blade guard with a second blade guard width is determined, wherein the second blade guard width is compiled from a first distance to the axis of rotation to the first blade guard edge and a second distance of the axis of rotation to the second blade guard edge, and the second distance is additionally used for calculating the fifth park position. In processing with the first and second blade guards, the fifth park position depends on the first and second main cutting angles. For the main cutting angles, three angle areas—negative main cutting angle, positive main cutting angle of 0° to 90°, and positive main cutting angle of 90° to 180°—are to be distinguished, yielding a total of nine different distances for the fifth park position.

In the first angle area the saw arm before the interruption of the controlled processing is arranged at a negative first main cutting angle between −180° and 0° and in the fifth park position the pivot axis has a distance to the second end point of maximum value $[B_b.1+\Delta_{mount}, B_b.2+\Delta_{mount}]$ for $-180° \leq -\alpha_2 \leq 0°$, maximum value of $(B_b.1+\Delta_{mount}, B_b.2+\Delta_{mount}, B_b.2+\delta\cdot\sin(\alpha_2)]$ for $0° < \alpha_2 \leq 90°$ and maximum value of $[B_b.1+\Delta_{mount}, B_b.2+\Delta_{mount}, B_b/2+\Delta_{mount}, B_b/2+\delta\cdot\sin(90°)]$ for $90° < \alpha_2 \leq 180°$.

In the second angle area the saw arm before the interruption of the controlled processing is arranged at a positive first main cutting angle between 0° and 90° and in the fifth park position the pivot axis has a distance to the second end point of maximum value $[B_b.1+\Delta_{mount}, B_b.2+\Delta_{mount}, B_b.1+\delta\cdot\sin(\alpha_1)]$ for $-180° \leq -\alpha_2 \leq 0°$, maximum value of $(B_b.1+\Delta_{mount}, B_b.2+\Delta_{mount}, B_b.1+\delta\cdot\sin(\alpha_1), B_b.2+\delta\cdot\sin(\alpha_2)]$ for $0° < \alpha_2 \leq 90°$ and maximum value of $[B_b.1+\Delta_{mount}, B_b.2+\Delta_{mount}, B_b.1+\delta\cdot\sin(\alpha_1), B_b.2+\delta\cdot\sin(90°)]$ for $90° < \alpha_2 \leq 180°$.

In the third angle area the saw arm before the interruption of the controlled processing is arranged at a positive first main cutting angle between 90° and 180° and in the fifth park position the pivot axis has a distance to the second end point of maximum value $[B_b.1+\Delta_{mount}, B_b.2+\Delta_{mount}, B_b.1+\delta\cdot\sin(90°)]$ for $-180° \leq -\alpha_2 \leq 0°$, maximum value of $[B_b.1+\Delta_{mount}, B_b.2+\Delta_{mount}, B_b.1+\delta\cdot\sin(90°), B_b.2+\delta\cdot\sin(\alpha_2)]$ for $0° < \alpha_2 \leq 90°$ and maximum value of $[B_b.1+\Delta_{mount}, B_b.2+\Delta_{mount}, B_b.1+\delta\cdot\sin(90°), B_b.2+\delta\cdot\sin(90°)]$ for $90° < \alpha_2 \leq 180°$.

After the resumption of the controlled processing the wall saw is positioned in a resumption position corresponding to the fourth park position. In the resumption position the wall saw is pivoted to the second main cutting angle and the saw head is then moved in a negative feed direction counter to the positive feed direction in the direction of the first end point.

Embodiments of the invention are described below based on the drawings. These do not necessarily represent the embodiments to scale; instead, where helpful for the explanation the drawings are produced in schematic and/or slightly distorted form. Regarding additions to the teachings directly evident from the drawings, reference is made to the relevant prior art. It must be kept in mind that various modifications and changes to the form and detail of an embodiment can be made without deviating from the general idea of the invention. The invention's features disclosed in the description, drawings and claims can be essential both individually and in any combination for the development of the invention. In addition, all combinations of at least two of the features described in the description, drawings and/or claims fall within the framework of the invention. The general idea of the invention is not restricted to the exact shape or detail of the embodiments shown and described below or restricted to a subject matter that would be restricted compared to the subject matter claimed in the claims. Where dimension areas are given, values lying inside the given boundaries are also disclosed as limit values and can be used and claimed randomly. For the sake of simplicity, the same reference signs are used below for identical or similar parts or parts with identical or similar function.

DETAILED DESCRIPTION OF THE DRAWINGS

Figure 1:
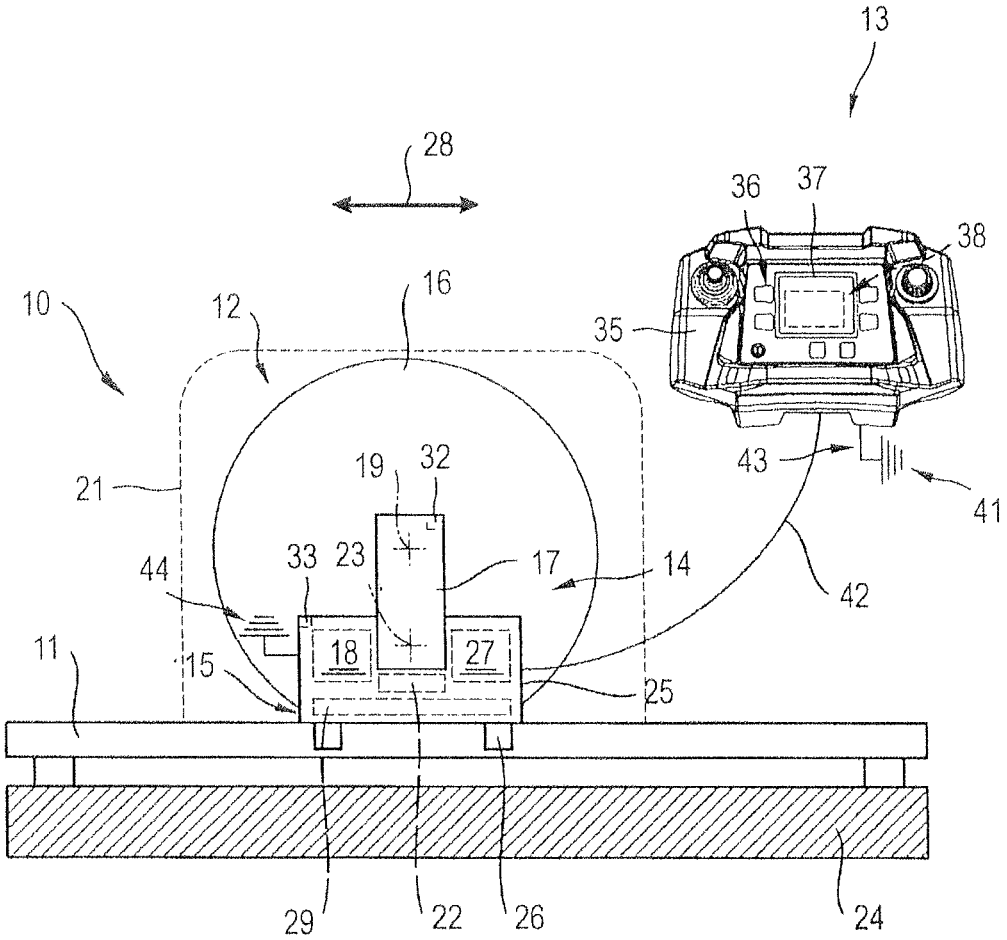
FIG. 1 illustrates a wall saw system with a guide rail and a wall saw.

FIG. 1 shows a wall saw system 10 with a guide rail 11, a tool device 12 arranged displaceable on the guide rail 11 and a remote control 13. The power tool is configured as a wall saw 12 and comprises a processing unit 14 and a motor-driven feed unit 15. The processing unit is configured as a saw head 14 and includes a machining tool 16 designed as a saw blade, which is attached to a saw arm 17 and is driven by a drive motor 18 about an axis of rotation 19.

To protect the operator, the saw blade 16 is surrounded by a blade guard 21, which is secured by means of a blade guard holder on the saw arm 17. The saw arm 17 is formed from a pivoting motor 22 to pivot about a pivot axis 23. The pivot angle $\alpha$ of the saw arm 17 determines with a blade diameter D of the saw blade 16, how deep the blade 16 clips into a workpiece 24 to be processed. The drive motor 18 and the pivoting motor 22 are arranged in a device housing 25. The motor-driven feed unit 15 comprises a guide carriage 26 and a feed motor 27 that in the embodiment is also arranged in the device housing 25. The saw head 14 is fixed on the guide carriage 26 and designed to be displaceable through the feed motor 27 along the guide rail 11 in a feed direction 28. In the device housing 25 in addition to the motors 18, 22, 27 a control unit 29 is arranged for controlling the saw head 14 and the motor-driven feed unit 15.

To monitor the wall saw system 10 and the processing procedure, a sensor device is provided with several sensor elements. A first sensor element 32 is designed as a pivot angle sensor and a second sensor element 33 as a displacement sensor. The pivot angle sensor 32 measures the current pivot angle of the saw arm 17 and the displacement sensor 33 measures the current position of the saw head 14 on the guide rail 11. The measured values are transmitted by the pivot angle sensor 32 and displacement sensor 33 to the control unit 29 and used for controlling the wall saw 12.

The remote control 13 comprises a device housing 35, an input device 36, a display device 37, and a control unit 38 that is arranged in the interior of the device housing 35. The control unit 38 converts the inputs of the input device 36 into control commands and data that are transmitted via a first communication link to the wall saw 12. The first communication link is configured as a wireless and cordless communication link 41 or a communications cable 42. The wireless and cordless communication link is formed in the embodiment as a radio link 41 created between a first radio unit 43 on the remote control 13 and a second radio unit 44 on the power tool 12.

Alternatively, the wireless and cordless communication link 41 can be in the form of an infrared, Bluetooth, WLAN or Wi-Fi connection.

Figure 2A:
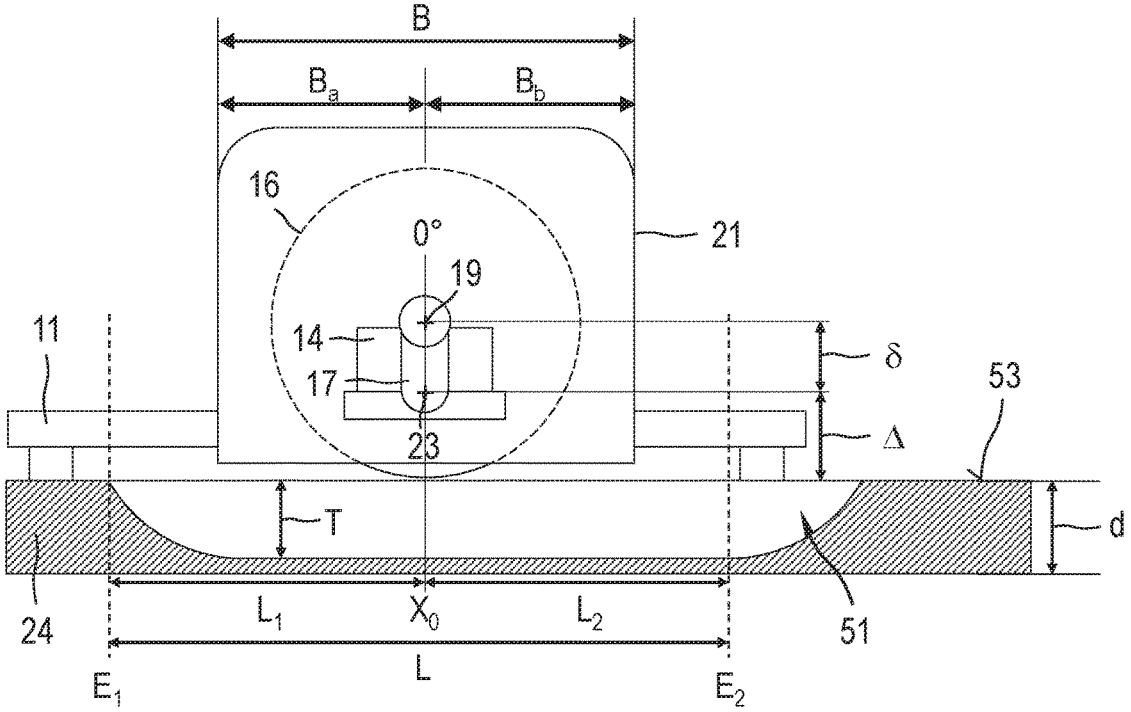
FIGS. 2A, B illustrate processing of a separation cut between a first and second free end point without barrier.

FIGS. 2A, B show the guide rail 11 and the wall saw 12 of the wall saw system 10 of FIG. 1 at the creation of a separation cut 51 in the workpiece 24 of workpiece thickness d. The separation cut 51 has a final depth T and extends in the feed direction 28 between a first end point $E_1$ and a second end point $E_2$ A direction parallel to the feed direction 28 is defined as the X direction, wherein the positive X direction is from the first end point $E_1$ to the second end point $E_2$, and a direction perpendicular to the X direction into the workpiece 24 is defined as the Y direction and is also called the depth direction.

The end point of a separation cut can be defined as free end point without barrier or as barrier. Both end points can be defined as free end points without barrier, both end points as barrier, or one end point as free end point and the other end point as barrier. An overcut can be allowed at a free end point without barrier. Through the overcut, at the end point the depth of cut reaches the final depth T of the separation cut. In the embodiment of FIGS. 2A, B the end points $E_1$, $E_2$ form free end points without barrier, wherein on the free first end point $E_1$ an overcut is not permissible and on the second end point $E_2$ there is an overcut.

FIG. 2A shows the saw head 14 in a mounting position $X_0$ and the saw arm 17 in a basic position of 0°. The saw head 14 is positioned by the operator by means of the guide carriage 26 in the mounting position $X_0$ the guide rail 11. The mounting position $X_0$ of the saw head 14 lies between the first and second end points $E_1$, $E_2$ and is determined by the position of the pivot axis 23 in feed direction 28. The position of the pivot axis 23 is particularly suited as reference position $X_{Ref}$ for the position monitoring of the saw head 14 and control of the wall saw 12, since the X position of the pivot axis 23 also remains unchanged during the pivoting movement of saw arm 17. Alternatively, another X position on the saw head 14 can be established as reference position, wherein in this case the distance in the X direction to the pivot axis 23 must additionally be known.

The X positions of the first and second end points $E_1$, $E_2$ are determined in the embodiment by the entry of partial lengths. The distance between the mounting position $X_0$ and t be first end point $E_1$ determines a first partial length $L_1$ and the distance between the mounting position $X_0$ and the second end point $E_2$ a second partial length. Alternatively, the X positions of the end points $E_1$, $E_2$ can be established by entering a partial length ($L_1$ or $L_2$) and a total length L as the distance between the end points $E_1$, $E_2$.

The separation cut 51 is produced in multiple partial cuts until the desired final depth T is reached. The partial cuts between the first and the second end points $E_1$, $E_2$ are defined as the main cut and the cutting sequence of the main cut as the main cutting sequence. At the end points of the separation cut an additional corner processing can be performed, which with a barrier is called barrier processing and with a free end point with overcut is called overcut processing.

The main cutting sequence can be determined by the operator, or the control unit of the wall saw system determines the main cutting sequence depending on several boundary conditions. Usually the first main cut, also called precut, is made with a reduced depth of cut and a reduced power of the drive motor to prevent a polishing of the saw blade. The remaining main cuts are normally done with the same depth of cut, but can also have different cut depths. The boundary conditions usually established by an operator include the cut depth of the precut, the power of the precut, and the maximum depth of cut of the remaining main cuts. The control unit can determine the main cutting sequence from these boundary conditions.

The main cuts of a separation cut are done with one saw blade diameter or with two or more saw blade diameters. If multiple saw blades are used, the processing usually starts with the smallest saw blade diameter. To be able to mount the saw blade 16 on the saw arm 17, in the basic position of saw arm 17 the saw blade 16 must be arranged above the workpiece 24. Whether this boundary condition is fulfilled depends on two device-specific sizes of the wall saw system 10: a perpendicular distance Δ between the pivot axis 23 of saw arm 17 and an upper side 53 of the workpiece 24; and the saw arm length δ of saw arm 17, defined as the distance between the axis of rotation 19 of saw blade 16 and the pivot axis 23 of saw arm 17. If the total of these two device-specific amounts is greater than half the saw blade diameter D/2, the saw blade 16 in the basic position is arranged above the workpiece 24. The saw arm length δ is a fixed device-specific amount of wall saw 12, whereas the perpendicular distance Δ between the pivot axis 23 and the surface 53 besides the geometry of wall saw 12 also depends on the geometry of the guide rail 11 used.

The saw blade 16 is fastened on a flange on saw arm 17 and in the saw operation is driven by drive motor 18 around the axis of rotation 19. In the basic position of saw arm 17, shown in FIG. 2A, the pivot angle is 0° and the axis of rotation 19 of the saw blade 16 lies in depth direction above pivot axis 23. The saw blade 16 is moved by a pivoting movement of saw arm 17 around the pivot axis 23 from the basic position at 0° into the workpiece 24. During the pivoting movement of saw arm 17, saw blade 16 is driven by drive motor 18 around the axis of rotation 19.

Figure 2B:
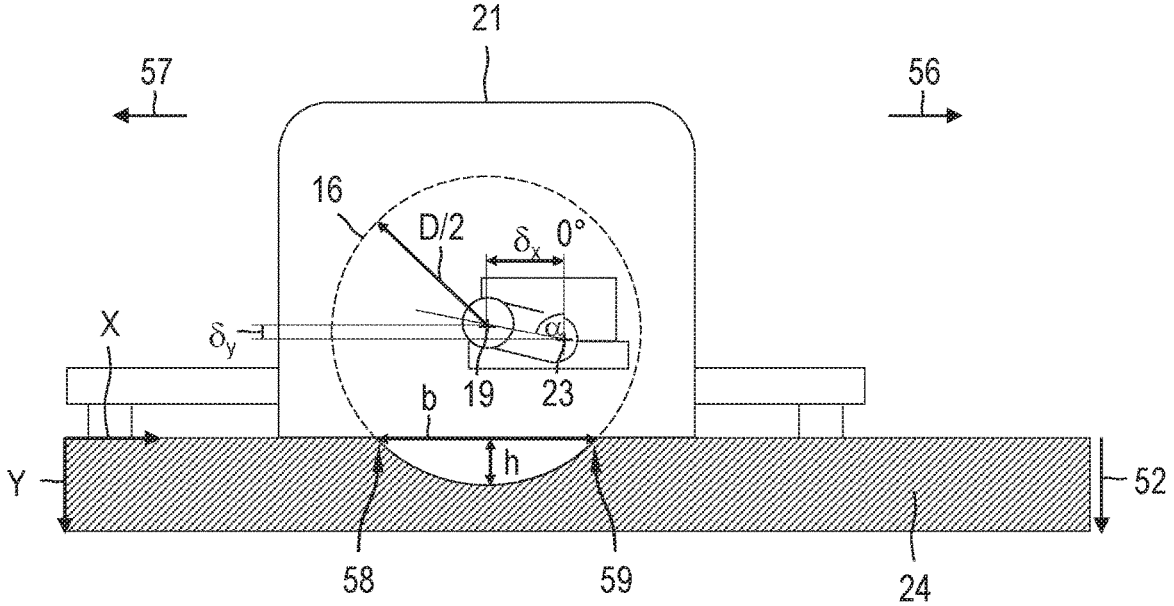

To protect the operator, during operation the saw blade 16 should be surrounded by blade guard 21. Wall saw 12 is operated either with blade guard 21 or without blade guard 21. For processing of the separation cut in the area of end points $E_1$, $E_2$, a dismounting of blade guard 21 can be provided. If different saw blade diameters are used for processing the separation cut, different blade guards with corresponding blade guard width are also used, FIG. 2B shows saw arm 17, which in the negative rotational direction 54 is inclined at negative pivot angle −α. In the negative rotational direction 54 the saw arm 17 is adjustable between pivot angles from 0° to −180°, and in a positive rotational direction 55 counter to the negative rotational direction 54 is adjustable between pivot angles from 0° to +180°. The arrangement of saw arm 17 shown in FIG. 2B is identified as pulling if saw head 14 is moved in a positive feed direction 56. If saw head 14 is moved in a negative feed direction 57 counter to the positive feed direction 56, the arrangement of saw arm 17 is called pushing.

The maximum penetration depth of saw blade 16 into workpiece 24 is reached at a pivot angle of ±180°. The position of the axis of rotation 19 in the X direction and Y direction is shifted by the pivoting movement of saw arm 17 around pivot axis 23. The displacement of pivot axis 19 depends on the saw arm length δ and pivot axis α of saw arm 17. The displacement $\delta_x$ in the X direction is $\delta\cdot\sin(\pm\alpha)$ and the displacement $\delta_y$ in the Y direction is $\delta\cdot\cos(\pm\alpha)$.

The saw blade 16 produces in workpiece 24 a cutting edge in the shape of a circular segment with a height h and width b. The height h of the circular segment corresponds to the penetration depth of saw blade 16 into workpiece 24. The relationship $D/2=h+\Delta+\delta\cdot\cos(\alpha)$ applies for the penetration depth h, where D designates the saw blade diameter, h the penetration depth of saw blade 16, Δ the perpendicular distance between pivot axis 23 and upper side 53 of workpiece 24, δ the saw arm length and a the first pivot angle, and for the width b relationship $b^2=D/2\cdot 8h-4h^2=4Dh-4h^2=4h\cdot(D-h)$ applies, where h designates the penetration depth of saw blade 16 into workpiece 24 and D the saw blade diameter.

The control of wall saw 12 during the separation cut depends on whether the end points are defined as barriers, and if there is a barrier whether the processing is done with blade guard 21 or without blade guard 21. With a free end point without barrier, the control of wall saw 12 in the inventive method occurs through upper exit points of saw blade 16 at upper side 53 of workpiece 24. The upper exit points of saw blade 16 can be calculated from the reference position $X_{Ref}$ of pivot axis 23 in the X direction, displacement $\delta_x$ of axis of rotation 19 in the X direction, and width b. An upper exit point facing the first end point $E_1$ is designated as first upper exit point 58, and an upper exit point facing the second end point $E_2$ as second upper exit point 59. For the first upper exit point 58 applies $X(58)=X_{Ref}+\delta_x-b/2$, and for the second upper exit point 59 applies $X(59)=X_{Ref}+\delta_x+b/2$ with $b=\sqrt{[h\cdot(D-h)]}$ and h=h (α, D).

If the end points $E_1$, $E_2$ are defined as barriers, an overrun of the end points $E_1$, $E_2$ with wall saw 12 is not possible. In this case the control of wall saw 12 in the inventive method occurs through the reference position $X_{Ref}$ of pivot axis 23 and the limit of wall saw 12. A distinction is made between a processing without blade guard 21 and a processing with blade guard 21.

Figure 3A:
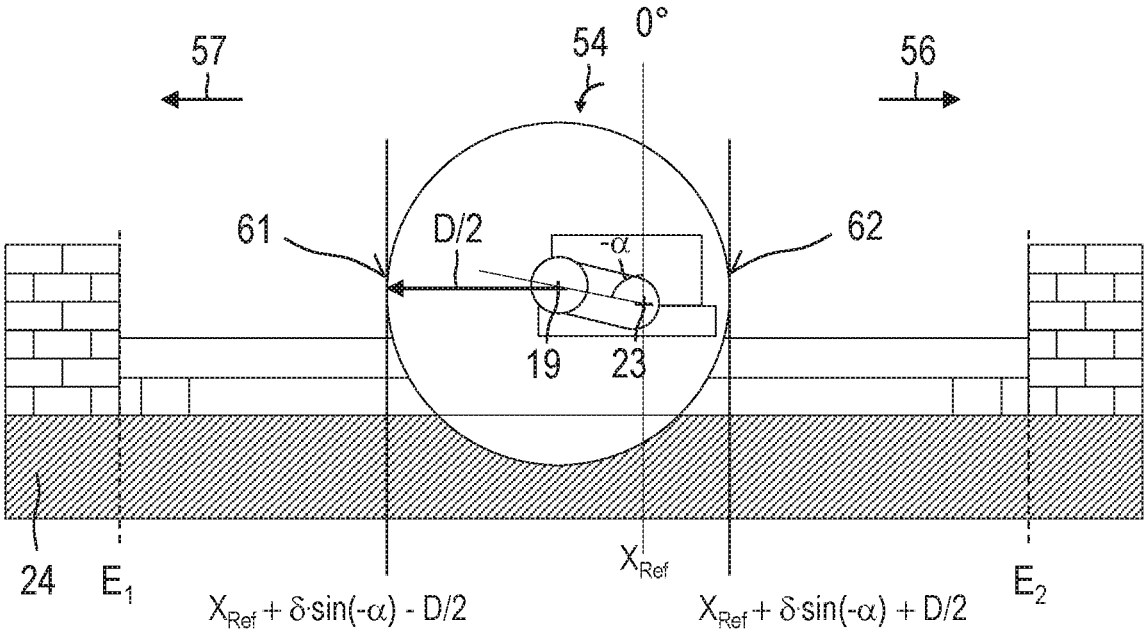
FIGS. 3A, B illustrate processing of a separation cut between a first and second barrier with a saw blade that is not surrounded by a blade guard.

FIGS. 3A, B show the wall saw system 10 when producing a separation cut between the first end point $E_1$ and the second end point $E_2$, which are defined as barriers, wherein the processing occurs without blade guard 21. In the processing without blade guard 21, a first blade edge 61 facing the first end point $E_1$ and a second blade edge 62 facing the second end point $E_2$ form the limit of the wall saw 12.

Figure 3B:
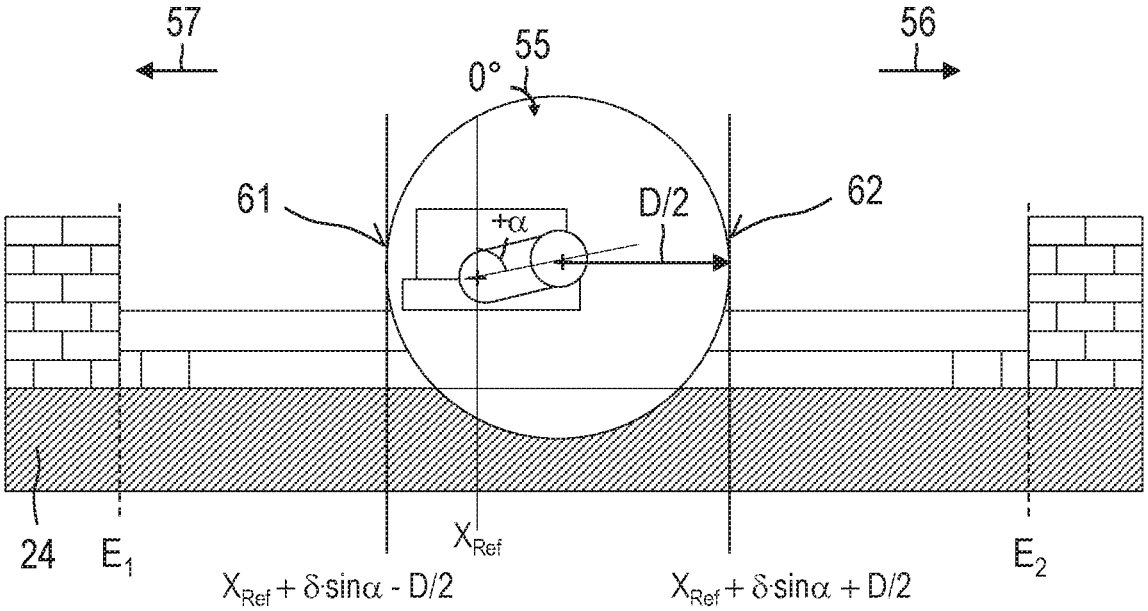

The X positions of the first and second saw blade edges 61, 62 in the X direction can be calculated from the reference position $X_{Ref}$ of pivot axis 23, displacement $\delta_x$ of axis of rotation 19 and saw blade diameter D. FIG. 3A shows the wall saw 12 with the saw arm 17 inclined in the negative rotational direction 54 at a negative pivot angle −α (0° to −180°). For the first saw blade edge 61 applies $X(61)=X_{Ref}+\delta\cdot\sin(-\alpha)-D/2$ and for the second saw blade edge 62 applies $X(62)=X_{Ref}+\delta\cdot\sin(+\alpha)-D/2$. FIG. 3B shows wall saw 12 with saw arm 17 inclined in a positive rotational direction 55 at a positive pivot angle α (0° to +180°). For the first saw blade edge 61 applies $X(61)=X_{Ref}+\delta\cdot\sin(\alpha)-D/2$ and for the second saw blade edge 62 applies $X(62)=X_{Ref}+\delta\cdot\sin(\alpha)+D/2$.

Figure 4A:
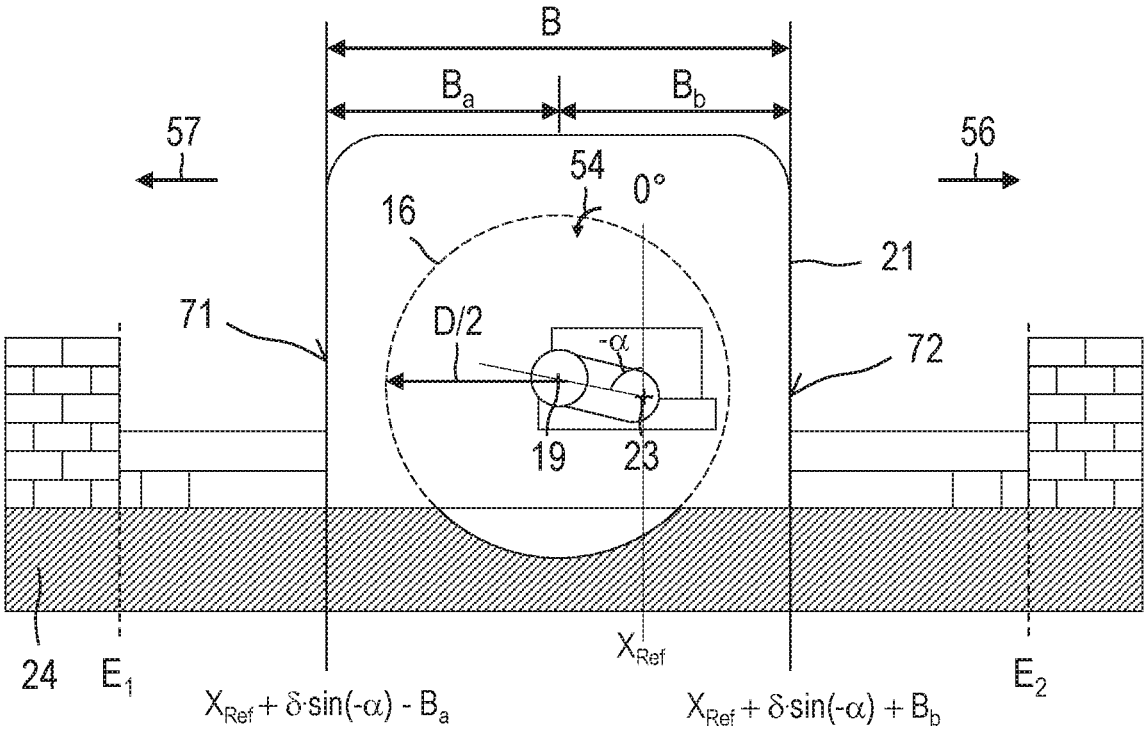
FIGS. 4A, B illustrate processing of a separation cut between a first and second barrier with a saw blade that is surrounded by a blade guard.

FIGS. 4A, B show the wall saw system 10 when creating a separation cut between the first end point $E_1$ and the second end point $E_2$, defined as barriers, wherein the processing is done with blade guard 21. In the processing with blade guard 21, a first blade guard edge 71 facing the first end point $E_1$, and a second blade guard edge 72 facing the second end point $E_2$, form the limit of wall saw 12.

The X positions of the first and second blade guard edges 71, 72 in the X direction can be calculated from the reference position $X_{Ref}$ of pivot axis 23, displacement $\delta_x$ of axis of rotation 19 and blade guard width B. FIG. 4A shows the wall saw 12 with saw arm 17 inclined at a negative pivot angle −α (0° to −180°), and a mounted blade guard 21 of blade guard width B. In an asymmetrical blade guard, before the start of the controlled processing the distances of the axis of rotation 19 to the blade guards 71, 72 are determined, wherein the distance to the first blade guard edge 71 is identified as first distance $B_a$ and the distance to the second blade guard edge 72 as second distance $B_b$.

Figure 4B:
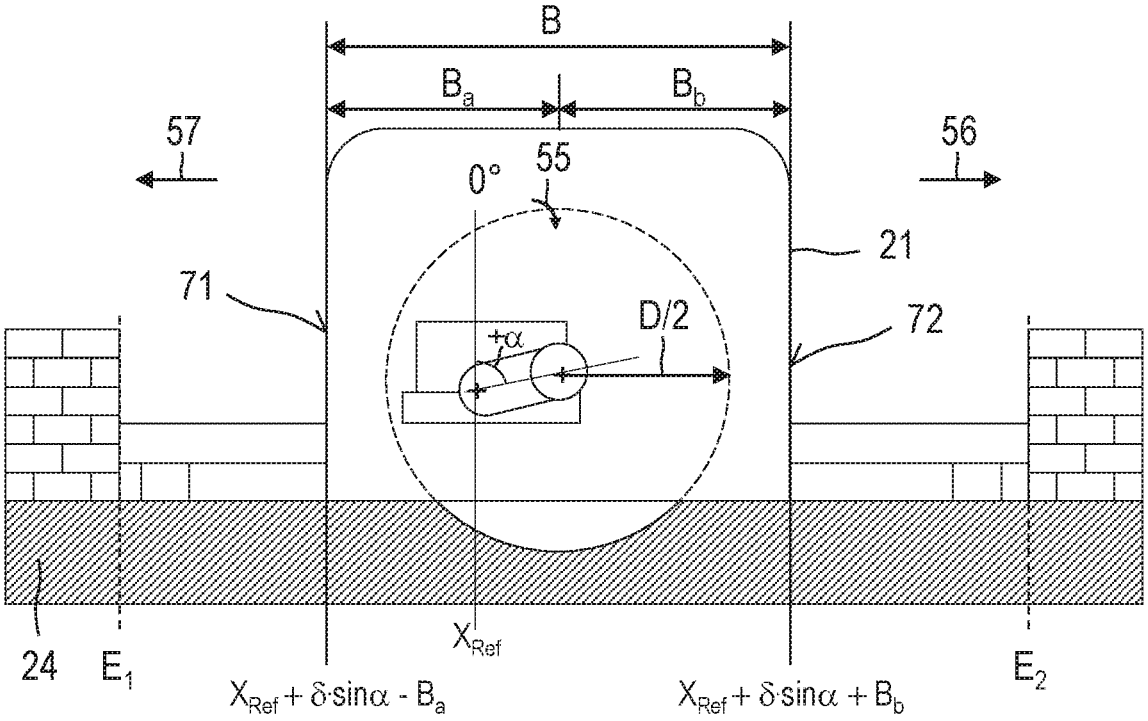

For the first blade guard edge 71 applies $X(71)=X_{Ref}+\delta\cdot\sin(\alpha)-B_a$ and for the second blade guard edge 72 applies $X(72)=X_{Ref}+\delta\cdot\sin(\alpha)+B_b$. FIG. 4B shows the wall saw 12 with the saw arm 17 inclined at positive swivel angle α(0° to +180°), and the mounted blade guard 21 of the blade guard width B. For the first blade guard edge 71 applies $X(71)=X_{ref}+\delta\cdot\sin(\alpha)-B_a$ and for the second blade guard edge 72 applies $X(72)=X_{Ref}+\delta\cdot\sin(\alpha)+B_b$.

FIGS. 2A, B show a separation cut between two end points $E_1$, $E_2$, which are defined as free end points without barrier, and FIGS. 3A, B and 4A, B show a separation cut between two end points $E_1$, $E_2$, which are defined as barriers. In practice, separation cuts are also possible in which one end point is defined as a barrier and the other end is a free end without barrier, wherein the control of the wall saw with the free end point occurs through the upper exit point of the saw blade and with the barrier through the blade edge (processing without blade guard 21) or the blade guard edge (processing with blade guard 21).

The first upper exit point 58, the first blade edge 61 and the first blade edge guard 71 are summarized under the term "first limit" of wall saw 12 and the second upper exit point 59, the second blade edge 62 and the second blade guard edge 72 are summarized under the term "second limit."

FIGS. 5A-H show the wall saw system 10 of FIG. 1 with the guide rail 11 and wall saw 12 when creating a separation cut of final depth T in the workpiece 24 between a the first end point $E_1$ that is a barrier and a second end point $E_2$, that is a free end point without barrier.

The processing of the separation is done with the help of the inventive method for controlling a wall saw system. The separation cut is made in a main cutting sequence of several main cuts until the desired final depth T is reached. The main cutting sequence comprises a precut (zeroed main cut) with a zeroed main cutting angle $\alpha_0$ of the saw arm 17, a zeroed diameter $D_0$ and a zeroed penetration depth $h_0$ of the saw blade used, a first main cut with a first main cutting the saw arm 17, a first diameter $D_1$ and first penetration depth $h_1$ of the saw blade used, a second main cut with a second main cutting angle $\alpha_2$ of the saw arm 17, a second diameter $D_2$ and a second penetration depth $h_2$ of the saw blade used, as well as a third main cut with a third main cutting angle $\alpha_3$ of the saw arm 17, a third diameter $D_3$ and a third penetration depth $h_3$ of the saw blade used.

The precut and the first main cut are made by a first saw blade 16.1 with a first saw blade diameter D.1 and a first blade guard 21.1 with a first blade guard width B.1. The zeroed diameter $D_0$ of the precut and the first diameter $D_1$ match the first saw blade diameter D.1, and the zeroed width $B_0$ of the precut and the first width $B_1$ of the first main cut match the first blade guard width B.1. The second main cut and the third main cut are made by a second saw blade 16.2 with a second saw blade diameter D.2 and a second blade guard 21.2 with a second blade guard width B.2. The second diameter $D_2$ of the second main cut and the third diameter $D_3$ of the third main cut match the second saw blade diameter D.2, and the second width $B_2$ of the second main cut and the third width $B_3$ of the third main cut match the second blade guard width B.2.

The main cuts of a separation cut are advantageously either done with a pulling saw arm 17 or the saw arm 17 is arranged alternatingly pulling and pushing. The pulling arrangement of saw arm 17 enables a stable guiding of the saw blade during the processing and a narrow kerf. A separation cut in which the saw arm is arranged alternatingly pulling and pushing has the advantage that the nonproductive times necessary for positioning the saw head 14 and pivoting the saw arm 17 are reduced.

In the embodiment of FIGS. 5A-H the processing in all main cuts occurs with the pulling saw arm 17. The processing of the separation cut starts at the second end point E2. After the start of the inventive method the saw head 14 is positioned in a start position $X_{Start}$ in which the pivot axis 23 has a distance of $\sqrt{[h_0(D_0-h_0)]}+\delta\cdot\sin(\alpha_0)$ to the second end point $E_2$, where $h_0=h(\alpha_0, D_0)=D_0/2-\Delta-\delta\cdot\cos(\alpha_0)$ denotes the penetration depth of the saw blade into the workpiece 24 at the zeroed main cutting angle $\alpha_0$ with zeroed diameter $D_0$, corresponding to the first saw blade diameter D.1. In the start position the saw arm 17 is pivoted from the basic position 0° in the positive direction of rotation 55 at the positive zeroed main cutting angle $\alpha_0$. The saw head 14 is then moved with the inclined saw arm 17 and rotating first saw blade 16.1 in the negative feed direction 57.

Figure 5A:
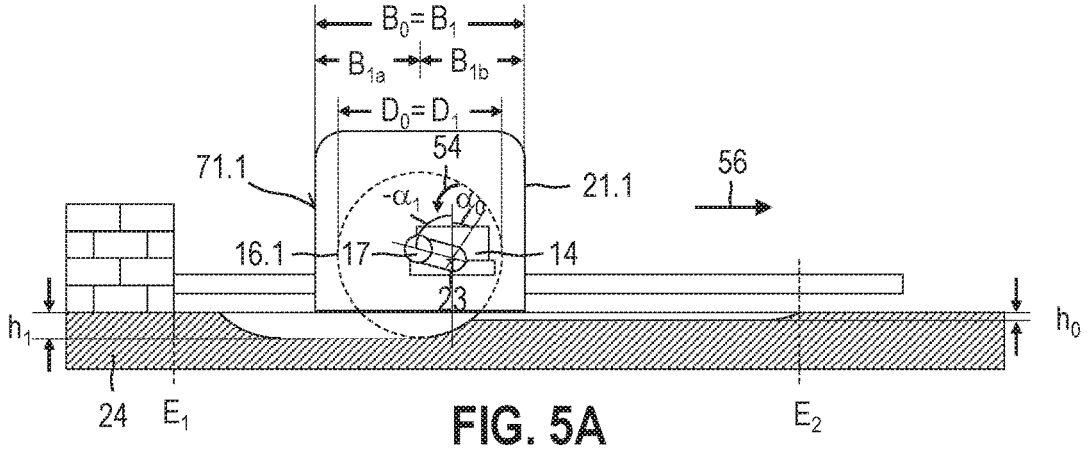
FIGS. 5A-H illustrate the wall saw system of FIG. 1 in creating a separation cut between a first free end point that is a barrier and a second free end point without barrier.

Since the first blade guard 21.1 is mounted, the control of the wall saw 12 at the first end point $E_1$ occurs through the first blade guard edge 71.1 of the first blade guard 21.1. The saw head 14 is stopped if the pivot axis 23 has a distance of $B_1/2-\delta\cdot\sin(-\alpha_1)$ to the first end point $E_1$. The first width $B_1$ of the blade guard used corresponds to the first blade guard B.1 width of the first blade guard 21.1. The saw arm 17 is then rotated in the negative direction of rotation 54 at the negative first main cutting angle $-\alpha_1$ and the saw head 14 with the saw arm 17 inclined at $-\alpha_1$ is moved in the positive feed direction 56 (FIG. 5A). In the embodiment, the transition from the precut to the first partial cut is done without removal of the residual material. Alternatively, the precut can be ended with a complete removal of the residual material with the precut or a partial removal.

The saw head 14 is moved in the positive feed direction 56 until that the pivot axis 23 has a distance of $\sqrt{[h_1(D_1-h_1)]}+\delta\cdot\sin(-\alpha_1)$ to the second end point $E_2$, where $h_1=h(-\alpha_1, D_1)=D_1/2-\Delta-\delta\cdot\cos(-\alpha_1)$ designates the penetration depth of the first saw blade 16.1 into the workpiece 24 at the negative first main cutting angle $-\alpha_1$ with the first diameter $D_1$, which corresponds to the first saw blade diameter D.1. The saw arm 17 is then pivoted in the positive direction of rotation 55 at the positive first main cutting angle $\alpha_1$ and the residual material removed.

Figure 5B:
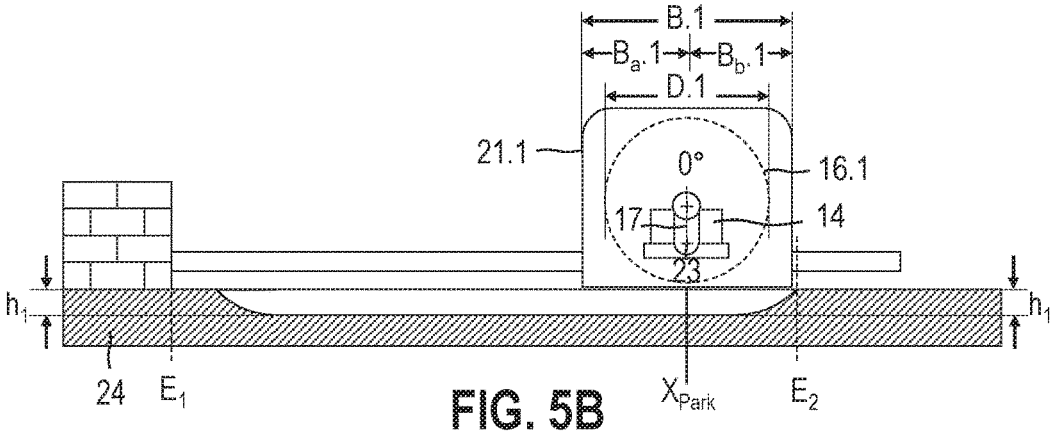

To change the saw blade from the first saw blade 16.1 to the second saw blade 16.2, saw head 14 is positioned in a park position $X_{Park}$ and saw arm 17 is pivoted out from the workpiece 24, wherein saw arm 17 in the embodiment is pivoted into the basic position of 0° (FIG. 5B). The positioning of saw head 14 into the park position and the rotation movement of saw arm 17 can occur in succession or be done simultaneously.

The park position should fulfill various boundary conditions. The first saw blade 16.1 and the first blade guard 21.1 can be dismounted in the park position. The second saw blade 16.2 and the second blade guard 21.2 can be mounted in the park position. Furthermore, the movement path to the positioning of saw head 14 for the second main cut should be as small as possible; ideally, the park position corresponds to the start position for the second main cut.

Since the second end point $E_2$ is a free end point without barrier, the dismounting of the first saw blade 16.1 and first blade guard 21.1, as well as the mounting of the second saw blade 16.2 and second blade guard 21.2 are easily possible. In the park position shown in FIG. 5B, the pivot axis 23 has a distance of $\sqrt{[h_2(D_2-h_2)]}+\delta\cdot\sin(\alpha_2)$ to the second end point $E_2$, where $h_2=h(\alpha_2, D_2)=D_2/2-\Delta-\delta\cdot\cos(\alpha_2)$ designates the penetration depth of the second saw blade 16.2 into the workpiece 24 at the positive second main cutting angle $\alpha_2$ with the second diameter $D_2$, which correspond to the second saw blade diameter D.2.

Figure 5C:
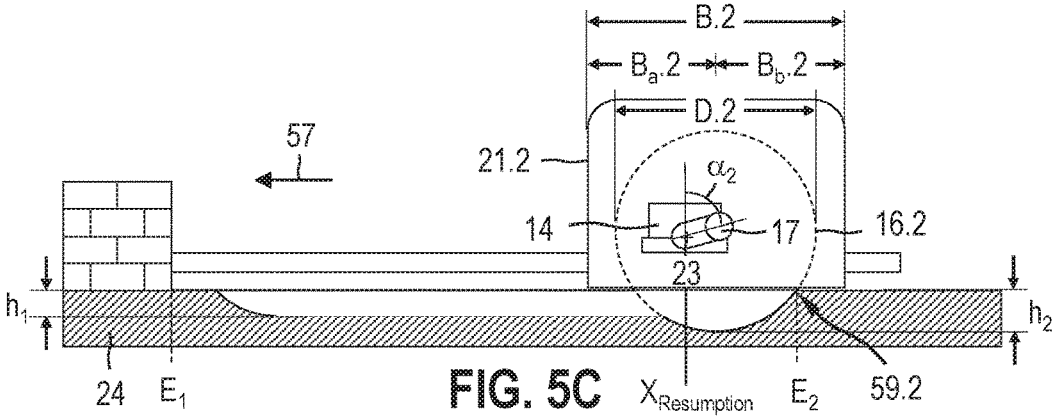
Figure 5D:
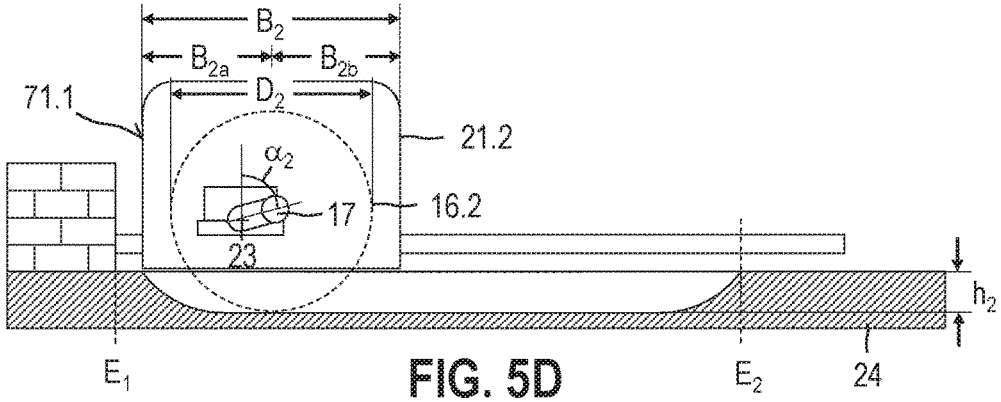

After the mounting of the second saw blade 16.2 and second blade guard 21.2, as well as the resumption of the controlled processing, the wall saw 12 is positioned by the control unit 29 into a resumption position $X_{Resumption}$ that corresponds to the park position $X_{Park}$. In calculating the park position the distance was set such that the second upper exit point 59.2 facing the second end point $E_2$ of the second saw blade 16.2 after the rotation movement of saw arm 17 at the positive second main cutting angle $\alpha_2$ coincides with the second end point $E_2$ (FIG. 5C). The downtimes can be reduced by this positioning.

In the resumption position $X_{Resumption}$, the saw arm 17 is rotated in the positive direction of rotation 55 at the positive second main cutting angle $\alpha_2$. The saw head 14 is moved with the saw arm 17 inclined at the second main cutting angle $\alpha_2$ and the rotating second saw blade 16.2 in the negative feed direction 57. The transition from the second main cut to the third main cut is done analogously to the transition from the precut to the first main cut with a complete removal of the residual material (FIG. 5D), or alternatively with a partial removal of the residual material or without removal of the residual material. The control of the wall saw is done by means of the first blade guard edge 71.2 of the second blade guard 21.2.

In practice, it is common when cutting a workpiece to perform the last main cut at the maximum pivot angle of the saw arm, in order to remove as much material in the region of the end points as possible. Without limiting the allowable maximum depth of cut the maximum pivot angle is ±180° and with restriction the allowable maximum depth of cut of the saw blade can be converted to a maximum pivot swivel angle. In the embodiment, the third main cut corresponds to the last main cut and is done at a third main cutting angle of −180°.

Figure 5E:
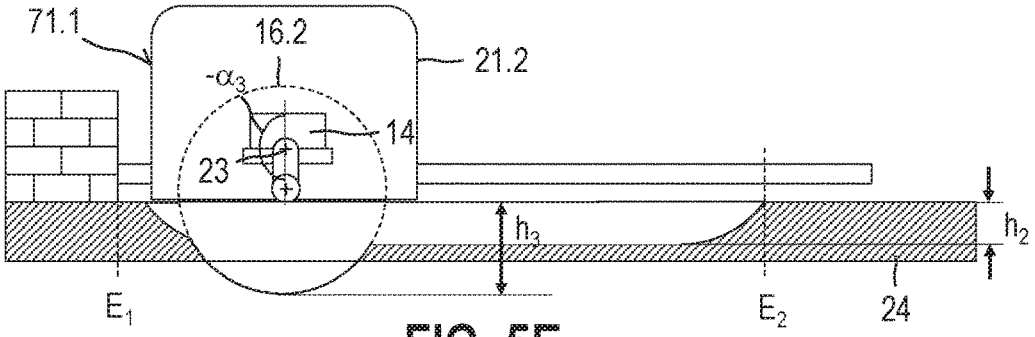
Figure 5F:
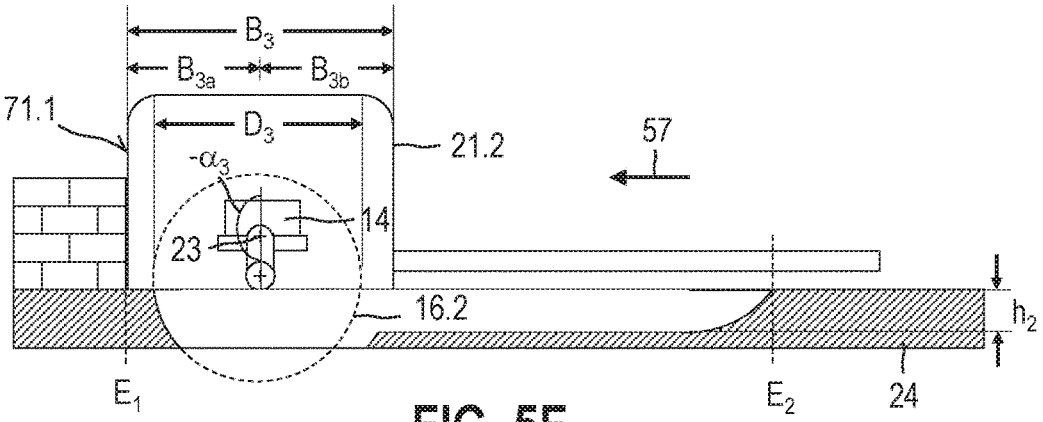
Figure 5G:
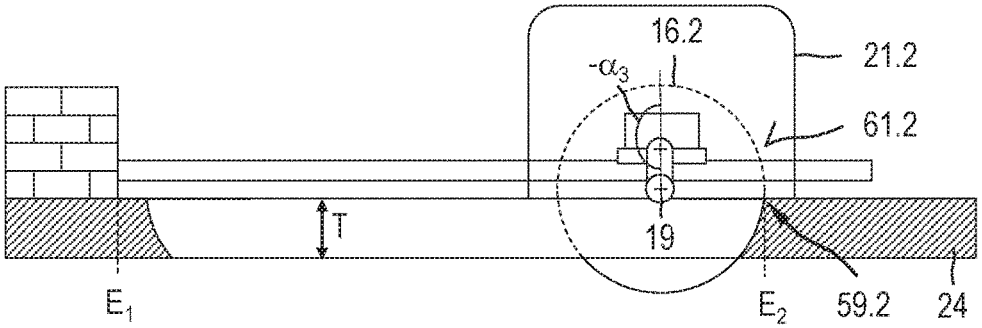

The positioning of saw head 14 for the third main cut at the maximum pivot angle of −180° is done by means of the critical angle of −90°. The critical angle of −90° must be taken into consideration since the first end point $E_1$ may not exceed the pivot movement. The pivot axis 23 at the critical angle of −90° has a distance of $B.2/2-\delta\cdot\sin(-90°)=B.2/2+\delta$ to the first end point $E_1$. The saw arm 17 is then pivoted into the third main cutting angle of −180° (FIG. 5E).

Since the third main cut is the last main cut of the main cutting sequence, before the processing of the last main cut a corner processing of the first end point $E_1$ is done. For that the saw head 14 is moved with the saw arm 17 inclined at −180° (FIG. 5F) in the negative feed direction 57 until the first blade guard edge 71.2 of the second blade guard 21.2 coincides with the first end point $E_1$. The corner processing of the first end point $E_1$ can be improved if the second blade guard 21.2 is dismounted and the corner processing is done without blade guard. Without blade guard the saw head 14 is moved with saw arm 17 inclined at −180° in the negative feed direction 57 until the first saw blade edge 61.2 of second saw blade 16.2 coincides with the first end point $E_1$.

Figure 5H:
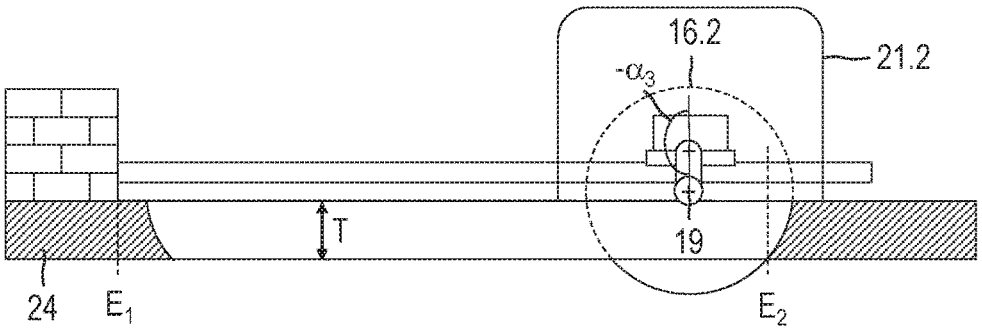

After the corner processing of the first end point $E_1$, the third main cut is done with the saw arm 17 inclined at the negative third main cutting angle $-\alpha_3$ in the positive the direction 56. The feed movement of saw head 14 is stopped if the pivot axis 23 has a distance of $\sqrt{[h_3(D_3-h_3)]}+\delta\cdot\sin(180°)=\sqrt{=h_3\cdot(D_3-h_3)]}$ to the second end point $E_2$, where $h_3=h(-\alpha_3, D_3)=D_3/2-\Delta-\delta\cdot\cos(-180°)=D_3/2-\Delta+\delta$ is the penetration depth of the saw blade into the workpiece 24 the negative third main cutting angle $-\alpha_3$ with the third diameter $D_3$, which corresponds to the second saw blade diameter D.2. If at the second end point $E_2$ an overcut is allowed, after the third main cut there is a corner processing of the second end point $E_2$ (FIG. 5H).

In the separation cut shown in FIGS. 5A-H, the pivoting movement of saw arm 17 occurs at a new main cutting angle in one pivoting movement. With hard materials or less powerful drive motors 18 it can be advantageous for saw blade 16 to perform the pivoting movement of saw arm 17 in at least two steps with interim angles, wherein between the pivoting movements to the interim angles in each case a free cut of saw blade 16 occurs.

Figure 6A:
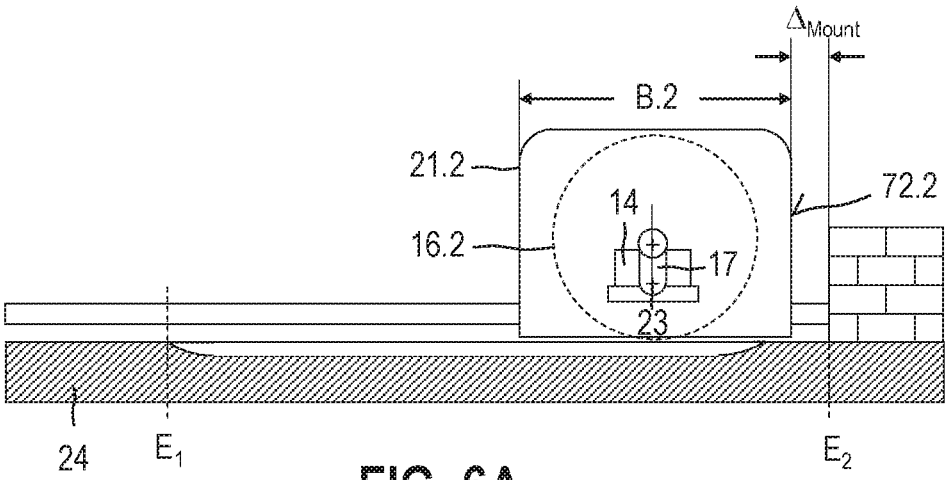
FIGS. 6A-B illustrate the wall saw system of FIG. 1 in creating a further separation cut between a first free end point without barrier and a second end point that is a barrier.
Figure 6B:
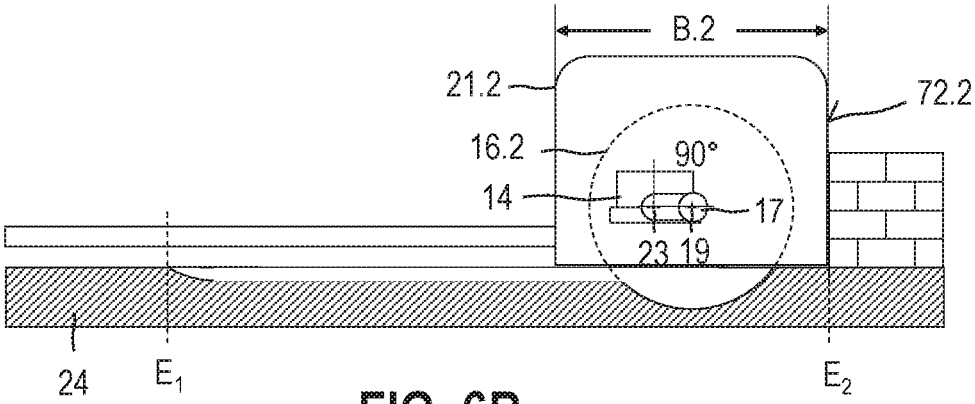

FIGS. 6A, 6B show the wall saw system 10 with guide rail 11 and wall saw 12 when creating another separation cut between a first end point $E_1$, which represents a free end point without barrier, and a second end point $E_2$ that is a barrier. The control of wall saw 12 at the first end point $E_1$ occurs through the first upper exit point 59 of the saw blade used and at the second end point $E_2$ through the first saw blade edge 61 (without blade guard 21) or the first blade guard edge 71 (with blade guard 21).

The cutting sequence comprises a first main cut at a first main cutting angle $\alpha_1$ of saw arm 17, a first diameter $D_1$ and the first penetration depth $h_1$ of the saw blade used, as well as a subsequent second main cut at a second main cutting angle $\alpha_2$ of saw arm 17, a second diameter $d_2$ and a second penetration depth $h_2$ of the saw blade used.

The first main cut is made by the first saw blade 16.1 and the first blade guard 21.1 and the second main cut is made by the second saw blade 16.2 and second blade guard 21.2. The first diameter $D_1$ and the first width $B_1$ of the first main cut match the first saw blade diameter D.1 and the first blade guard width B.1. The second diameter $D_2$ and the second width $B_2$ the second main cut match the second blade guard diameter D.2 and the second blade guard width B.2.

The boundary conditions that apply for the park position are:

- dismounting of the first blade 16.1 and first blade guard 21.1,
- mounting of the second saw blade 16.2 and second blade guard 21.2, pivoting out of the saw arm 17 with the first saw blade 16.1 from the first main cutting angle $\alpha_1$ into the basic position at 0°, and
- pivoting in of the saw arm 17 with the second saw blade 16.2 from the basic position at 0° into the second main cutting angle $\alpha_2$.

The dismounting of the first saw blade 16.1 and first blade guard 21.1 and the mounting of the second saw blade 16.2 and second blade guard 21.2 occur in the basic position of saw arm 17 at 0°. If the second end point $E_2$ is a barrier as in the embodiment, before the start of the controlled processing a mounting distance $\Delta_{mount}$ is additionally established. The mounting distance $\Delta_{mount}$ assures there is a sufficient distance for the operator between the barrier and the saw blade and between the barrier and the blade guard to grasp the saw blade and blade guard; a suitable mounting distance is, for example, 10 cm.

With the processing with blade guard, in principle a minimum distance to the second end point ($E_2$) of $B_b.1+\Delta_{mount}$ for the first blade guard 21.1 and $B_b.2+\Delta_{mount}$ for the second blade guard 21.2 is necessary. Since the first blade guard width B.1 is smaller than the second blade guard width B.2, with symmetrical blade guards it is sufficient to consider the second blade guard width B.2 in the calculation of the minimum distance for the mounting; with asymmetrical blade guards, both minimum distances must be considered. The pivot axis 23 must have a distance of maximum value $[B_b.1+\Delta_{mount}, B_b.2+\Delta_{mount}]$ to the barrier at $E_2$ (FIG. 6A).

The necessary distances to the pivoting out of the first saw blade 16.1 and pivoting in of the second saw blade 16.2 at the second end point $E_2$ depend on the first main cutting angle $\alpha_1$ of the first main cut and the second main cutting angle $\alpha_2$ of the second main cut. A distinction must be made between negative main cutting angles of −180° to 0°, positive main cutting angle $\alpha$ of 0° to 90° and positive main cutting angle $\alpha$ of 90° to 180°. For positive main cutting angles $\alpha$ of 90° to 180° the critical angle of +90° must be considered, since the barrier at the second end point $E_2$ may not be exceeded in the pivoting movement. The pivot axis 23 at the critical angle of +90° has a distance to the second end point $E_2$ of $B_b.1+\delta\cdot\sin(90°)=B_b.1+\delta$for the first blade guard 21.1 and $B_b.2+\delta\sin(90°)=B_b.2+\delta$for the second blade guard 21.2 (FIG. 6B).

At negative first main cutting angles $-\alpha_1$ of −180° to 0°, the pivoting out of the first saw blade 16.1 into the basic position at 0° occurs on the side facing away from the second end point $E_2$ and the displacement is negative. For negative second main cutting angles $-\alpha_2$, positive second main cutting angles $\alpha_2$ of 0° to 90° and positive second main cutting angles $\alpha_2$ of 90° to 180°, different distances result.

At negative second main cutting angles $-\alpha_2$, the pivoting in of the second saw blade 16.2 occurs at the side facing away from the second end point $E_2$ and the distance necessary for the pivoting in is smaller than the minimum distance to the mounting; the control unit 29 chooses as park position for wall saw 12 the maximum value of $[B_b.1+\Delta_{mount}, B_b.2+\Delta_{mount}]$. At positive second main cutting angles $\alpha_2$ between 0° and 90°, for the pivoting in of the second saw blade 16.2 a distance of the pivot axis 23 to the barrier at $E_2$ of $B_b.2+\delta\cdot\sin(\alpha_2)$ is necessary and the control unit 29 chooses as park position for the wall saw 12 the maximum value of $(B_b.1+\Delta_{mount}, B_b.2+\Delta_{mount}, B_b.2+\delta\cdot\sin(\alpha_2)]$ for $0°<\alpha_2\leq 90°$. At positive second main cutting angles $\alpha_2$ between 90° and 180°, the distance necessary for the pivoting in of the second saw blade 16.2 of the pivot axis 23 to barrier $B_b.2+\delta\cdot\sin(90°)=B_b.2+\delta\cdot$ and the control unit 29 chooses as park position for wall saw 12 the maximum value of $[B_b.1+\Delta_{mount}, B_b.2+\Delta_{mount}, B_b.2+\delta\cdot\sin(90°)]$ for $90°<\alpha_2\leq 180°$.

At positive first main cutting angle $\alpha_1$ of 0° to 90°, the pivoting out of the first saw blade 16.1 to the basic position occurs on the side facing the second end point $E_2$. For the pivoting out of the first saw blade 16.1 a distance of the pivot axis 23 of $B_b.1+\delta\cdot\sin(\alpha_1)$ to the barrier is necessary. For negative second main cutting angles $-\alpha_2$, positive second main cutting angles $\alpha_2$ of 0° to 90° and positive second main cutting angles $\alpha_2$ of 90° to 180°, different distances result.

At negative second main cutting angles $\alpha_2$, the pivoting in of the second saw blade 16.2 occurs at the side facing away from the barrier and the control unit 29 chooses as park position for wall saw 12 the maximum value of $[B_b.1+\Delta_{mount}, B_b.2+\Delta_{mount}, B_b.1+\delta\cdot\sin(\alpha_1)]$. At positive second main cutting angles $\alpha_2$ from 0+ to 90°, for the pivoting in of the second saw blade 16.2 a distance of the pivot axis 23 to the barrier of $B_b.2+\delta\cdot\sin(\alpha_2)$ is necessary and the control unit 29 chooses as park position for the wall saw 12 the maximum value of $[B_b.1+\Delta_{mount}, B_b.2+\Delta_{mount}, B_b.1+\delta\cdot\sin(\alpha_1), B_b.2+\delta\cdot\sin(\alpha_2)]$. At positive second main cutting angles $\alpha_2$ between 90° and 180°, the distance necessary for the pivoting in of the second saw blade 16.2 of the pivot axis 23 to the barrier of $B_b.2+\delta\cdot\sin(90°)=B_b.2+\delta\cdot$ is necessary and the control unit 29 chooses as park position for wall saw 12 the maximum value of $[B_b.1+\Delta_{mount}, B_b.2+\Delta_{mount}, B_b.2+\delta\cdot\sin(90°)]$.

At positive first main cutting angle $\alpha_1$ of 90° to 180°, the pivoting out of the first saw blade 16.1 to the basic position occurs on the side facing the second end point $E_2$. For the pivoting out of the first saw blade 16.1 a distance of the pivot axis 23 of $B_b.1+\delta\cdot\sin(90°)=B_b.1+\delta$ to the barrier at $E_2$ is necessary. For negative second main cutting angles $-\alpha_2$, positive second main cutting angles $-\alpha_2$ of 0° to 90° and positive second main cutting angles $\alpha_2$ of 90° to 180°, different distances result.

At negative second main cutting angles $\alpha_2$, the pivoting in of the second saw blade 16.2 occurs at the side facing away from the barrier and the control unit 29 chooses as park position for wall saw 12 the maximum value of $[B_b.1+\Delta_{mount}, B_b.2+\Delta_{mount}, B_b.1+\delta\cdot\sin(90°)]$. At positive second main cutting angles $\alpha_2$ from 0° to 90°, for the pivoting in of the second saw blade 16.2 a distance of the pivot axis 23 to the barrier of $B_b.2+\delta\cdot\sin(\alpha_2)$ is necessary and the control unit 29 chooses as park position for the wall saw 12 the maximum value of $[B_b.1+\Delta_{mount}, B_b.2+\Delta_{mount}, B_b.1+\delta\cdot\sin(90°), B_b.2+\delta\cdot\sin(\alpha_2)]$. At positive second main cutting angles $\alpha_2$ of 90° to 180°, the distance necessary for the pivoting in of the second saw blade 16.2 of the pivot axis 23 to the barrier of $B_b.2+\delta\cdot\sin(90°)=B_b.2+\delta\cdot$ is necessary and the control unit 29 chooses as park position for wall saw 12 the maximum value of $B_b.1+\Delta_{mount}, B_b.2+\Delta_{mount}, B_b.1+\delta\cdot\sin(90°), B_b.2+\delta\cdot\sin(90°)]$.

If processing of the first and/or second partial cut is done without blade guard, the second saw blade edge 62 instead of the second saw blade edge 72 is used for calculating the minimum distances for the park position and the second saw blade width B.2 will replace the saw blade diameter D.2 of the second saw blade 16.2.

In the separation cuts shown in FIGS. 5A-H and FIGS. 6A, B the pivoting movement of saw arm 17 into the main cutting angle occurs in a pivoting movement. With hard materials or less powerful drive motors 18 it can be advantageous for the saw blade to perform the pivoting movement of saw arm 17 in at least two steps with interim angles, wherein between the pivoting movements to the interim angles in each case a free cut of the saw blade occurs.

The invention claimed is:

1. A method for controlling a wall saw system, wherein the wall saw system comprises a guide rail and a wall saw with a saw head, a motor-driven feed unit that moves the saw head parallel to a feed direction along the guide rail, a first saw blade having a first saw blade diameter (D.1) and a second saw blade having a second saw blade diameter (D.2), wherein the second saw blade diameter (D.2) is larger than the first saw blade diameter (D.1);

and comprising the steps of:

creating a separation cut of a final depth (T) in a workpiece of a workpiece thickness (d) between a first end point ($E_1$) and a second end point ($E_2$), wherein the first or the second saw blade is fastened to a saw arm of the saw head, the saw arm being pivotable around a pivot axis and the first or the second saw blade is driven around an axis of rotation;

wherein, before a start of a processing of the separation cut controlled by a control unit of the wall saw, at least the first saw blade diameter (D.1) of the first saw blade, the second saw blade diameter (D.2) of the second saw blade, positions of the first and second end points in the feed direction, the final depth (T) of the separation cut, and a cutting sequence of m cuts, m>2, are determined;

wherein the m cuts of the cutting sequence comprise at least a first cut with a first cutting angle ($\pm\alpha_1$) of the saw arm and the first saw blade diameter (D.1) of the first saw blade used in the first cut, and a subsequent second cut with a second cutting angle ($\pm\alpha_2$) of the saw arm and the second saw blade diameter (D.2) of the second saw blade used in the second cut;

wherein, during the processing of the separation cut controlled by the control unit:

the first cut is done with the first saw blade fastened to the saw arm, the saw arm being pivoted about the pivot axis in a positive rotational direction calculated from a basic position (0°) of the saw arm such that the first cutting angle is a positive angle or the saw arm being pivoted about the pivot axis in a negative rotational direction directed counter to the positive rotational direction calculated from the basic position (0°) of the saw arm such that the first cutting angle is a negative angle and the second cut is done with the second saw blade fastened to the saw arm, the saw arm being pivoted about the pivot axis in the positive rotational direction calculated from the basic position (0°) of the saw arm such that the second cutting angle is a positive angle or the saw arm being pivoted about the pivot axis in the negative rotational direction calculated from the basic position (0°) of the saw arm such that the second cutting angle is a negative angle; and the first cut is done with the saw head moved in a positive feed direction in the direction towards the second end point and the second cut is done with the saw head moved in a negative feed direction in the direction towards the first end point;

wherein, after the processing of the first cut of the separation cut controlled by the control unit with the first saw blade the processing of the separation cut is interrupted by the control unit and the wall saw is moved by the control unit and the motor-driven feed unit into a park position;

wherein before the start of the processing of the separation cut controlled by the control unit in addition a saw arm length (δ) of the saw arm, defined as a distance between the pivot axis and the axis of rotation, and a distance (Δ) between the pivot axis and an upper side of the workpiece are established and transmitted to the control unit, which uses the saw arm length (δ) and the distance (Δ) to calculate the park position for the wall saw.

* * * * *